US007209691B2

(12) United States Patent
Takahashi et al.

(10) Patent No.: US 7,209,691 B2
(45) Date of Patent: Apr. 24, 2007

(54) DEVELOPING DEVICE AND IMAGE FORMING APPARATUS

(75) Inventors: Keisuke Takahashi, Kasugai (JP); Mitsuru Horinoe, Aichi-ken (JP)

(73) Assignee: Brother Kogyo Kabushiki Kaisha, Aichi (JP)

( * ) Notice: Subject to any disclaimer, the term of this patent is extended or adjusted under 35 U.S.C. 154(b) by 0 days.

(21) Appl. No.: 11/384,275

(22) Filed: Mar. 21, 2006

(65) Prior Publication Data

US 2006/0216073 A1 Sep. 28, 2006

(30) Foreign Application Priority Data

Mar. 25, 2005 (JP) ..... 2005-088004

(51) Int. Cl.
*G03G 15/08* (2006.01)

(52) U.S. Cl. ..... 399/284

(58) Field of Classification Search ..... 399/384, 399/284

See application file for complete search history.

(56) References Cited

U.S. PATENT DOCUMENTS

| | | | | |
|---|---|---|---|---|
| 4,521,098 | A * | 6/1985 | Hosoya et al. | 399/283 |
| 5,761,590 | A * | 6/1998 | Sato | 399/284 |
| 6,094,554 | A | 7/2000 | Ichikawa et al. | |
| 6,151,474 | A | 11/2000 | Ichikawa et al. | |
| 6,163,674 | A | 12/2000 | Ichikawa et al. | |
| 6,169,869 | B1 * | 1/2001 | Inami et al. | 399/284 |
| 6,192,209 | B1 | 2/2001 | Ichikawa et al. | |
| 6,198,893 | B1 | 3/2001 | Ichikawa et al. | |
| 6,226,484 | B1 | 5/2001 | Ichikawa et al. | |
| 6,295,433 | B1 | 9/2001 | Ichikawa et al. | |
| 6,336,022 | B2 | 1/2002 | Ichikawa et al. | |
| 2004/0126692 | A1 * | 7/2004 | Yamanouchi et al. | 430/110.3 |

FOREIGN PATENT DOCUMENTS

| | | | |
|---|---|---|---|
| JP | 60-51867 | A | 3/1985 |
| JP | 8-202133 | A | 8/1996 |
| JP | 10-63095 | A | 3/1998 |
| JP | 10-239894 | A | 9/1998 |
| JP | 11-95480 | A | 4/1999 |
| JP | 2001-134159 | A | 5/2001 |
| JP | 2001-159830 | A | 6/2001 |
| JP | 2003-5436 | A | 1/2003 |

* cited by examiner

*Primary Examiner*—David M. Gray
*Assistant Examiner*—Ruth N. LaBombard
(74) *Attorney, Agent, or Firm*—McDermott Will & Emery LLP

(57) ABSTRACT

A developing device includes a developer carrier capable of carrying a developer, and a thickness regulating member having a resistance of $10^3$ Ω or less and regulating a thickness of a layer of a developer carried by the developer carrier.

5 Claims, 3 Drawing Sheets

DEVELOPING DEVICE AND IMAGE FORMING APPARATUS

CROSS REFERENCE TO RELATED APPLICATION

This application claims priority from Japanese Patent Application No. 2005-088004, filed on Mar. 25, 2005, the entire subject matter of which is incorporated herein by reference.

TECHNICAL FIELD

Aspects of the present invention relate to a developing device, and an image forming apparatus, such as a laser printer, equipped with the developing device.

BACKGROUND

Various attempts for suppressing longitudinal streaks from occurring in images have been conventionally made in a developing device having a developing roller and a thickness regulating blade for regulating the thickness of a toner layer carried on the developing roller.

For example, JP-A-10-063095 discloses such a technique relating to a developing device that a rigid material is used as a surface of a developing roller, and an elastic foamed material is used as a toner regulating blade, whereby surface flaws on the developing roller are prevented from occurring to suppress image deterioration, such as longitudinal streaks, from occurring.

SUMMARY

In the developing device disclosed in JP-A-10-063095, however, the toner regulating blade has a resistance of from $10^4$ to $10^9$ Ω, whereby dusts occurring upon handling the developing device by a user or loose materials from the toner are attached to the toner regulating blade, and the attached dusts and loose materials bring about longitudinal streaks on images.

In particular, it is the current practice that a polymerized toner produced by the polymerization method is covered with an external additive to a coverage of 100% on the surface thereof to prevent the toner particles from being attached to each other, whereby the fluidity of the toner is maintained. The technique can maintain the fluidity of the toner and improve the charging property thereof. However, in the case where a toner regulating blade having a resistance of from $10^4$ to $10^9$ Ω as in JP-A-10-063095 is used, the external additive is partly released while the toner particles are scrubbed between the blade and the developing roller or collide with each other, and the released external additive is attached to the toner regulating blade, whereby the external additive attached to the toner regulating blade causes longitudinal streaks on images.

Aspects of the invention provide such a developing device that longitudinal streaks on images are suppressed from occurring, the service life is improved in terms of number of sheets with high quality images, and particularly, longitudinal streaks on images are suppressed from occurring upon using a developer maintaining fluidity. Also, an image forming apparatus equipped with the developing device is provided.

According to an aspect of the invention, there is provided a developing device including a developer carrier capable of carrying a developer, and a thickness regulating member having a resistance of $10^3$ Ω or less and regulating a thickness of a layer of a developer carried by the developer carrier.

In the developing device, since the thickness regulating member is formed of an electroconductive material having a resistance of $10^3$ Ω or less, the thickness regulating member itself is hard to be charged, and thus dusts occurring upon handling the developing device and loose materials from the developer are suppressed from being attached to the thickness regulating member, whereby longitudinal streaks on images are suppressed from occurring to improve the service life in terms of number of sheets with high quality images.

BRIEF DESCRIPTION OF THE DRAWINGS

Illustrative aspects of the invention may be more readily described with reference to the accompanying drawings.

DETAILED DESCRIPTION (Total Constitution)

Figure 1:
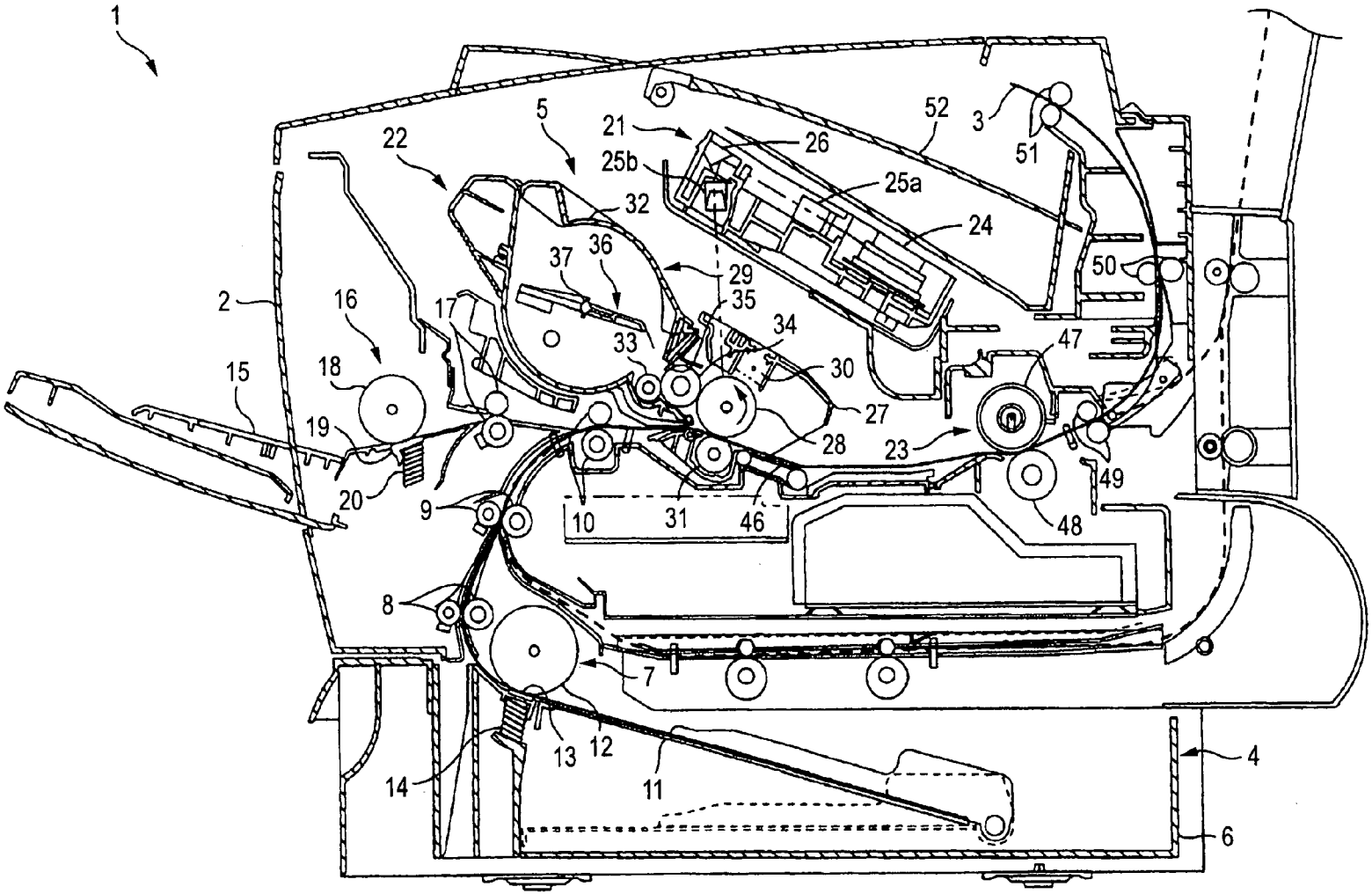
FIG. 1 is a cross sectional view of a laser printer as an image forming apparatus according to an aspect of the invention, in which a developing cartridge is installed as an a developing device according to another aspect of the invention.
Figure 2:
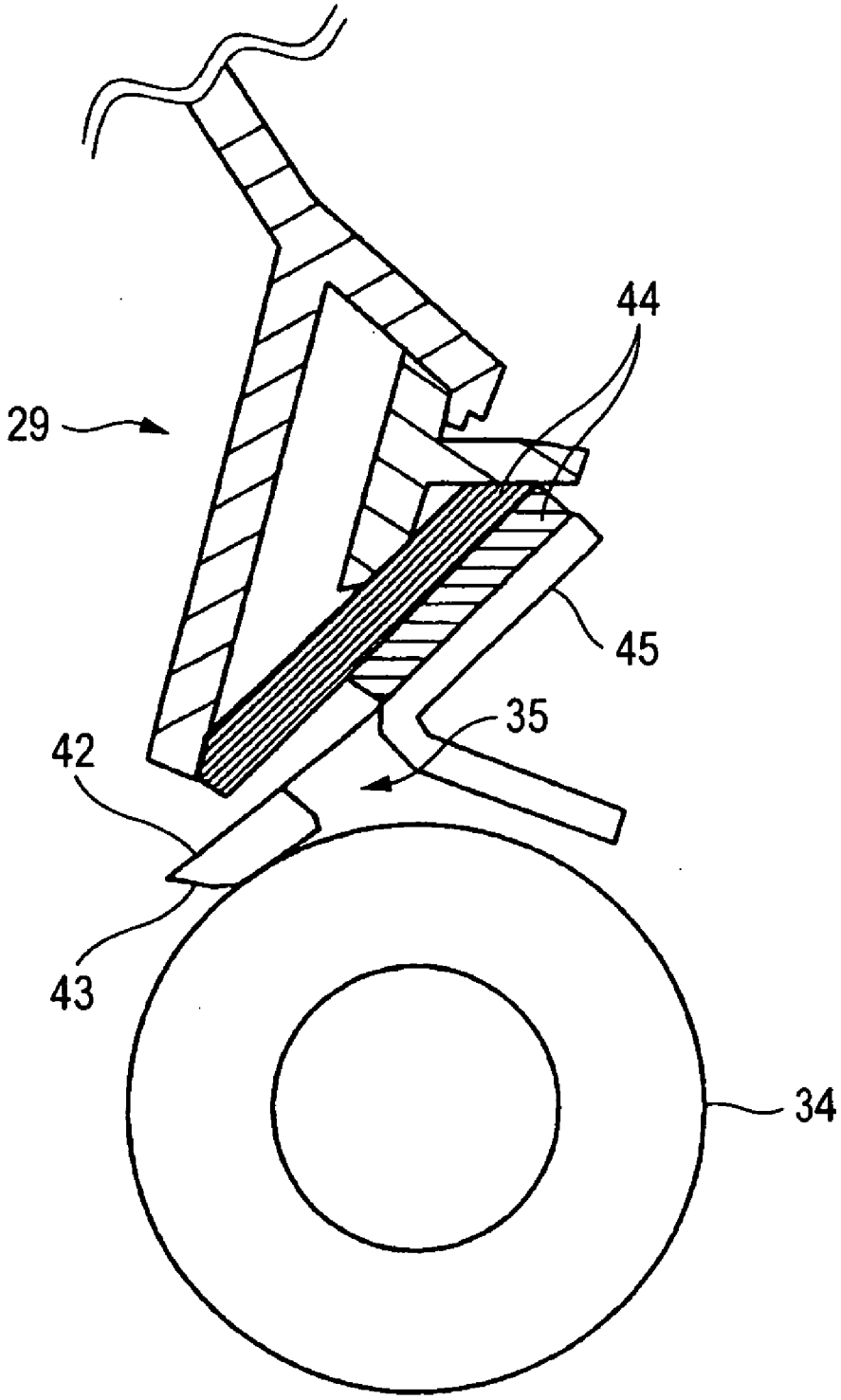
FIG. 2 is an enlarged view of a surrounding part of a blade unit in FIG. 1.

FIG. 1 is a cross sectional view of a laser printer 1 as an image forming apparatus according to an aspect of the invention, in which a developing cartridge 29 is installed as a developing device according to another aspect of the invention. FIG. 2 is an enlarged view of a surrounding part of a blade unit 35 in FIG. 1.

In FIG. 1, the laser printer 1 is such a laser printer of an electrophotographic system that forms an image through the non-magnetic mono-component developing system, in which a sheet supplying part 4 for supplying sheets 3 and an image forming part 5 for forming an image on the supplied sheet 3 are provided in a main chassis 2.

(Constitution of Paper Feeding Part)

The sheet feeding part 4 has a sheet feeding tray 6 detachably provided in a bottom part of the main chassis 2, a sheet feeding mechanism 7 provided on one end part of the sheet feeding tray 6, conveying rollers 8 and 9 provided on the downstream side of the sheet feeding mechanism 7 in the conveying direction of the sheet 3, and registration rollers 10 provided on the downstream side of the conveying rollers 8 and 9 in the conveying direction of the sheet 3.

The sheet feeding tray 6 has a box shape with an upper opening capable of housing stacked sheets 3, and is installed in the bottom part of the main chassis 2 detachably in the horizontal direction. A sheet pressing plate 11 is provided in the sheet feeding tray 6.

The sheet feeding mechanism 7 has a sheet feeding roller 12, a separating pad 13 facing the sheet feeding roller 12, and a spring 14 disposed behind the separating pad 13, and the separating pad 13 is pressed toward the sheet feeding roller 12 with an urging force of the spring 14.

The registration rollers 10 are constituted by a pair of rollers and delivers the sheet 3 to the image forming position (i.e., a contact part of a photosensitive drum 28 and a transfer roller 31 described later) after the prescribed registration process.

The sheet feeding part 4 of the laser printer 1 also has a multipurpose tray 15 having sheets 3 of an arbitrary size stacked thereon, a multipurpose sheet feeding mechanism 16 for feeding the sheet 3 stacked on the multipurpose tray 15, and a multipurpose conveying rollers 17.

The multipurpose sheet feeding mechanism 16 has a multipurpose sheet feeding roller 18, a multipurpose separating pad 19 facing the multipurpose sheet feeding roller 18, and a spring 20 disposed behind the multipurpose separating pad 19, and the multipurpose separating pad 19 is pressed with an urging force of the spring 20.

(Constitution of Image Forming Part)

The image forming part 5 has a scanner part 21, a process unit 22, and a fixing part 23.

(Constitution of the Scanner Part)

The scanner part 21 is provided in an upper part of the main chassis 2 and has a laser light-emitting part, which is not shown in the figure, a polygon mirror 24 rotatablly driven, lenses 25*a* and 25*b*, and a reflector 26. A laser beam based on prescribed image data emitted from the laser light-emitting part is transmitted through or reflected with the polygon mirror 24, the lens 25*a*, the reflector 26 and the lens 25*b* in this order to make the laser beam incident on a surface of a photosensitive drum 28 of the process unit 22 described later in a high-speed scanning manner.

(Constitution of Process Unit)

The process unit 22 is disposed below the scanner part 21 and is detachably installed in the main chassis 2. The process unit 22 has a photosensitive cartridge 27 having provided therein a photosensitive drum 28, a developing cartridge 29 as a developing device, a scorotron charging device 30, and a transfer roller 31.

(Constitution of Developing Cartridge)

The developing cartridge 29 is detachably attached to the photosensitive cartridge 27 and has a toner hopper 32, a feeding roller 33 provided on a lateral position of the toner hopper 32, a developing roller 34 as a developer carrier, and a blade unit 35.

A non-magnetic mono-component toner having positively charging property as a developer is housed in the toner hopper 32. The toner may be a polymerized toner, which is obtained by polymerizing a polymerizable monomer by a known polymerization method, such as a suspension polymerization method. Examples of the polymerizable monomer include a styrene monomer, such as styrene, and an acrylic monomer, such as acrylic acid, an alkyl (C1 to C4) acrylate, and an alkyl (C1 to C4) methacrylate. The polymerized toner has an approximately spherical shape and is excellent in fluidity. The toner is mixed with a colorant, such as carbon black, and wax, and externally added with an external additive, such as silica, at a coverage of the external additive of 100%, and preferably from 100 to 150%, for preventing the polymerized toner particles from being aggregated with each other for improving the fluidity. The toner has an average particle diameter of about from 6 to 10 μm.

The toner may be added with a charge controlling agent having positively charging property, such as nigrosine, triphenylmethane and a quaternary ammonium salt, dispersed on the surface of the toner. The charge controlling agent can accelerate charging of the toner by dispersing on the surface of the toner.

The toner hopper 32 is equipped with an agitator 36. The agitator 36 agitates the toner in the toner hopper 32 through rotation in an anticlockwise direction around a rotation axis 37 to deliver the toner to the feeding roller 33 described later.

The feeding roller 33 is provided rotatablly in a clockwise direction on a lateral position of the toner hopper 32. The feeding roller 33 is constituted by a metallic roller axis having covered thereon electroconductive polyurethane foam to form a roller surface.

The developing roller 34 is provided rotatablly in a clockwise direction on a lateral position of the feeding roller 33. The developing roller 34 is constituted by a metallic roller axis having covered thereon an electroconductive elastic material to form a coated roller surface, and more specifically, the coated roller as the developing roller 34 is constituted by silicone rubber as a base material and electroconductive urethane rubber as a coated material containing fluorine and carbon fine particles. The developing roller 34 is applied with a prescribed developing bias voltage with respect to the photosensitive drum 28.

The feeding roller 33 and the developing roller 34 are opposed to each other, and the feeding roller 33 is pressed onto the developing roller 34 to such an extent that the feeding roller 33 is compressed therewith to a certain degree. The feeding roller 33 is rotatablly driven in a downward direction at a position where the feeding roller 33 and the developing roller 34 are in contact with each other, and the developing roller 34 is rotatablly driven in an upward direction at a position where the feeding roller 33 and the developing roller 34 are in contact with each other, whereby the rollers rotate in directions opposite to each other.

The blade unit 35 is disposed above the feeding roller 33 along the axis direction of the developing roller 34 to face the developing roller 34 between, in the rotation direction of the developing roller 34, the position where the developing roller 34 faces the feeding roller 33 and the position where the developing roller 34 faces the photosensitive drum 28 described later. As shown in FIG. 2, the blade unit 35 has a plate spring 42, an electroconductive thickness regulating blade 43 as a thickness regulating member provided at a top end of the plate spring 42 and being in contact with the developing roller 34, a backup member 44 provided on a back surface of the plate spring 42, and a supporting member 45 for making the developing cartridge 29 support a back end of the plate spring 42.

In the blade unit 35, the electroconductive thickness regulating blade 43 is pressed onto the surface of the developing roller 34 with a weak pressing force of the plate spring 42, which is supported by the developing cartridge 29 with the supporting member 45.

The electroconductive thickness regulating blade 43 will be described in detail later.

Upon feeding the toner from the feeding roller 33 to the developing roller 34 in the developing cartridge 29, the feeding roller 33 and the developing roller 34 rotate in directions opposite to each other, and the rotation speed of the feeding roller 33 is twice or more the rotation speed of the developing roller 34, at the position where the rollers are in contact with each other, whereby the toner is strongly scrubbed between the feeding roller 33 and the developing roller 34 to charge the toner positively. Particularly, since the roller surface of the feeding roller 33 is constituted by urethane foam, charge between the feeding roller 33 and the toner can be significantly lowered, whereby only the toner in direct contact with the developing roller 34 is charged, and only the charged toner is carried on the developing roller 34. Furthermore, the polymerized toner having an approximately spherical shape is used as the toner in the developing cartridge 29, and therefore, the toner can be favorably fluidized to improve the charging characteristics.

The charged toner is carried on the surface of the developing roller 34 and enters to the gap between the developing roller 34 and the electroconductive thickness regulating blade 43. An excessive amount of the toner entering to the gap is scraped with the electroconductive thickness regulating blade 43 to form a favorable thin layer of the toner on the surface of the developing roller 34.

(Constitution of Photosensitive Drum)

The photosensitive drum 28 is disposed on a lateral position of the developing roller 34 to face the developing roller 34 and is supported rotatablly in an anticlockwise direction in the photosensitive cartridge 27. The photosensitive drum 28 has a drum main body, which is grounded, having thereon as a surface layer a photoconductive layer having positively charging property constituted, for example, by polycarbonate.

(Constitution of Scorotron Charging Device)

The scorotron charging device 30 is disposed above the photosensitive drum 28 to face the photosensitive drum 28 with a prescribed interval for preventing them from being in contact with each other, and is supported by the photosensitive cartridge 27. The scorotron charging device 30 is a charging device of scorotron type for positively charging, which generates corona discharge from a charging wire, and uniformly charges the surface of the photosensitive drum 28.

(Constitution of Transfer Roller)

The transfer roller 31 is disposed below the photosensitive drum 28 to face the photosensitive drum 28 and is supported by the photosensitive cartridge 27 rotatablly in a clockwise direction. The transfer roller 31 is constituted by a metallic roller axis having covered thereon an electroconductive rubber material to form a roller surface, and applied with a prescribed transferring bias voltage with respect to the photosensitive drum 28 upon transferring.

(Constitution of Fixing Part)

The fixing part 23 is provided on a lateral part of the process unit 22 and on a downstream side thereof in the conveying direction of the sheet 3, and has a heating roller 47, a pressure roller 48, and conveying rollers 49. The heating roller 47 is constituted by a metallic plain tube and a halogen lamp as a heater provided inside. The pressure roller 48 is disposed below the heating roller 47 to face it and presses the heating roller 47 from below. The conveying rollers 49 are provided on a downstream side of the heating roller 47 and the pressure roller 48 in the conveying direction of the sheet 3 for conveying the sheet 3 toward conveying rollers 50 and sheet delivery rollers 51 provided on the main chassis 2.

(Example of Image Forming Operation)

An example of a printing operation of the laser printer of the aspect having the aforementioned constitution will be described with reference to FIG. 1.

In the case where the sheet 3 stacked and housed in the sheet feeding part 4 is used for printing, the sheet 3 on the sheet pressing plate 11 is pressed toward the sheet feeding roller 12 from the back side of the sheet pressing plate 11 with a spring, which is not shown in the figure, and the uppermost sheet 3 is held by the sheet feeding roller 12 and the separating pad 13 through rotation of the sheet feeding roller 12, and is separated from the stacked sheets and delivered by cooperation of the sheet feeding roller 12 and the separating pad 13. The sheet 3 thus delivered is conveyed to the registration rollers 10 with the conveying rollers 8 and 9.

In the case where the sheet 3 carried on the multipurpose tray 15 is used for printing, the uppermost sheet 3 carried on the multipurpose tray 15 is held by the multipurpose sheet feeding roller 18 and the multipurpose separating pad 19 through rotation of the multipurpose sheet feeding roller 18, and is separated from the stacked sheets and delivered by cooperation of the multipurpose sheet feeding roller 18 and the multipurpose separating pad 19. The sheet 3 thus delivered is conveyed to the registration rollers 10 with the multipurpose conveying rollers 17.

During the delivery of the sheet 3, the surface of the photosensitive drum is uniformly charged positively with the scorotron charging device 30 and then exposed with a laser beam emitted from the scanner part 21 by a high-speed scanning manner, through rotation of the photosensitive drum 28, whereby an electrostatic latent image corresponding to prescribed image data is formed thereon.

Subsequently, through rotation of the developing roller 34, the positively charged toner carried on the surface of the developing roller 34 is selectively fed to and carried on the electrostatic latent image formed on the surface of the photosensitive drum 28, i.e., the exposed part having a potential lowered through exposure with the laser beam on the surface of the photosensitive drum 28 having been uniformly charged positively, whereby the latent image is visualized to complete reversal development.

The visualized image carried on the surface of the photosensitive drum 28 is then made in contact with the sheet 3 delivered from the registration rollers 10 of the sheet feeding part 4 after the prescribed registration process and transferred to the sheet 3 while the sheet 3 is passed between the photosensitive drum 28 and the transfer roller 31. The sheet 3 having the visualized image transferred thereon is conveyed to the fixing part 23 with the conveying belt 46.

The sheet 3 thus conveyed to the fixing part 23 is subjected to thermal fixing while the sheet 3 is passed between the heating roller 47 and the pressure roller 48, and then conveyed to the conveying rollers 50 and the sheet delivery rollers 51 provided on the main chassis 2 with the conveying rollers 49.

The conveying rollers 50 are provided on the downstream side of the conveying rollers 49 in the conveying direction of the sheet 3, and the sheet delivery rollers 51 are provided above a sheet discharge tray 52. The sheet 3 conveyed with the conveying rollers 49 is conveyed to the sheet delivery rollers 51 with the conveying rollers 50 and then discharged on the sheet discharge tray 52 with the sheet delivery rollers 51.

(Characteristics of Electroconductive Thickness Regulating Blade)

The electroconductive thickness regulating blade 43 will be described in detail below.

In the aspect, the electroconductive thickness regulating blade 43, which is in contact with the developing roller 34, is formed of electroconductive silicone rubber having a resistance of $10^3$ Ω or less. In the case where the electroconductive thickness regulating blade 43 is formed of an insulating material as in the conventional technique, the electroconductive thickness regulating blade 43 itself is liable to be charged, and thus the external additive, such as silica, released from the polymerized toner and dusts invading through gaps of the developing cartridge 29 are adsorbed by the electroconductive thickness regulating blade 43 through electric force. In the case where the electroconductive thickness regulating blade 43 is formed of an electroconductive material as in the aspect, on the other hand, the electroconductive thickness regulating blade 43 itself is hard to be charged, whereby the external additive, such as silica, released from the polymerized toner is suppressed from being attached to the electroconductive thickness regulating blade 43 even when a polymerized toner having a coverage of an external additive of 100%, and dusts invading through gaps of the developing cartridge 29 upon handling the developing cartridge 29, for example, exchanging the developing cartridge 29, are suppressed from being attached to the electroconductive thickness regulating blade 43.

Results of experiments are shown below where the electroconductive thickness regulating blade 43 formed of electroconductive silicone rubber having a resistance of $10^3$ Ω or less is used.

(Experiment 1)

On such an assumption that the factors contributing to attachment of an external additive released from a polymerized toner and dusts from the outside were ascribed to the electroconductive thickness regulating blade 43 itself, the electroconductive thickness regulating blade 43 was formed of electroconductive silicone rubber instead of insulating silicone rubber, and quality of images obtained by using the electroconductive thickness regulating blade 43 formed of electroconductive silicone rubber was investigated.

Table 1 shows the characteristics of the developing roller 34 used in the aspect, Table 2 shows the characteristics of the toner used in the aspect, and Table 3 shows comparison between the characteristics of the conventional insulating thickness regulating blade and the characteristics of the electroconductive thickness regulating blade 43 used in the aspect.

As shown in Table 1, a coated roller using silicone as a base material having an outer diameter of 20 mm was used as the developing roller 34.

TABLE 1

| Characteristics of Developing Roller | |
|---|---|
| Type | Coated roller |
| Outer diameter (mm) | 20 |
| Base material | silicone* |

*Note:
The coating agent was not silicone since the roller was a coated roller.

[Table 1]

Table 1 shows the characteristics of the developing roller 34 used in the aspect.

As shown in Table 2, a non-magnetic mono-component positively charged polymerized toner was used as the toner, which had a volume average particle diameter of 9.5 μm and was produced by adding carbon black as a colorant, a softening agent and a charge controlling agent as internal additives and small diameter silica, titanium oxide and large diameter silica as external additives were added to a styrene acrylate resin and PMMA formed to have a spherical shape by a suspension polymerization.

TABLE 2

| Characteristics of Toner | |
|---|---|
| Type | Non-magnetic mono-component positively charged polymerized toner |

TABLE 2-continued

| Characteristics of Toner | |
|---|---|
| Resin | styrene acrylate<br>PMMA |
| Internal additive | carbon black<br>softening agent<br>charge controlling agent |
| External additive | small diameter silica<br>titanium oxide<br>large diameter silica |
| Volume average particle diameter | 9.5 μm |

Table 2 shows the characteristics of the toner used in the aspect.

As shown in Table 3, the endurance printable number of sheets, which shows the service life in terms of number of sheets with high quality images, was 10,000 in the case where the conventional insulating thickness regulating blade was used with the developing roller 34 and the toner shown above, and the endurance printable number of sheets was 11,000 in the case where the electroconductive thickness regulating blade 43 of the aspect was used with the developing roller 34 and the toner shown above. Consequently, the service life in terms of number of sheets with high quality images using the electroconductive thickness regulating blade 43 was larger than that using the conventional insulating thickness regulating blade by 1.1 times.

The endurance printable number of sheets herein is a number of printed sheets in an endurance printing test with a printed area ratio of 1% and a printing speed of 3.5 ppm until the difference in reflectance (difference between the reflectance of non-printed sheet and the reflectance of the white background of sheet having been printed) measured with a reflective densitometer (Densitometer TC-6MC-D, produced by Tokyo Denshoku Co., Ltd.) becomes 2.0 or more. The electroconductive thickness regulating blade 43 used in the experiments was produced by casting rubbers containing electroconductive liquid silicone rubber or electroconductive millable silicone rubber in a mold. The resistance of the electroconductive thickness regulating blade 43 is an average value of resistances measured in five times by applying a voltage of 1 V to the electroconductive thickness regulating blade 43 formed of electroconductive liquid silicone rubber in Experiment 2 described later. As the material for forming the conventional insulating thickness regulating blade, a material having a resistance of $10^8$ Ω or more was used.

TABLE 3

| Characteristics of Electroconductive Blade | | |
|---|---|---|
| | Resistance (Ω) | Endurance printable number of sheets (service life) |
| Insulating blade | $10^8$ or more | 10,000 |
| Electroconductive liquid silicone rubber blade | $0.25 \times 10^3$ | 11,000 |

[Table 3]

Table 3 shows comparison between the characteristics of the conventional insulating thickness regulating blade and the characteristics of the electroconductive thickness regulating blade 43 used in the aspect.

It is confirmed from the results of the experiment that longitudinal streaks can be suppressed from occurring to improve the service life in terms of number of sheets with high quality images by using the electroconductive thickness regulating blade 43 of the aspect instead of the conventional insulating thickness regulating blade. As a result of the experiment using the electroconductive thickness regulating blade 43 formed by using electroconductive millable silicone rubber, the similar results were obtained as in the experiment using the electroconductive thickness regulating blade 43 formed by using electroconductive liquid silicone rubber.

(Experiment 2)

Noting the resistance of the electroconductive thickness regulating blade 43 used in the aspect, such an experiment was carried out that the resistance of samples of the electroconductive thickness regulating blade 43 formed of electroconductive millable silicone rubber or electroconductive liquid silicone rubber was measured in five times by changing the voltage applied thereto. Because the electroconductive millable silicone rubber suffered large fluctuation in resistance in the first experiment, the experiment was carried out twice. In the experiment, the resistance of samples the electroconductive thickness regulating blade 43 was measured in five times by changing the voltage applied thereto because the resistance suffered large fluctuation in resistance even though the resistance of the electroconductive thickness regulating blade 43 was measured in the same manner.

Figure 3:
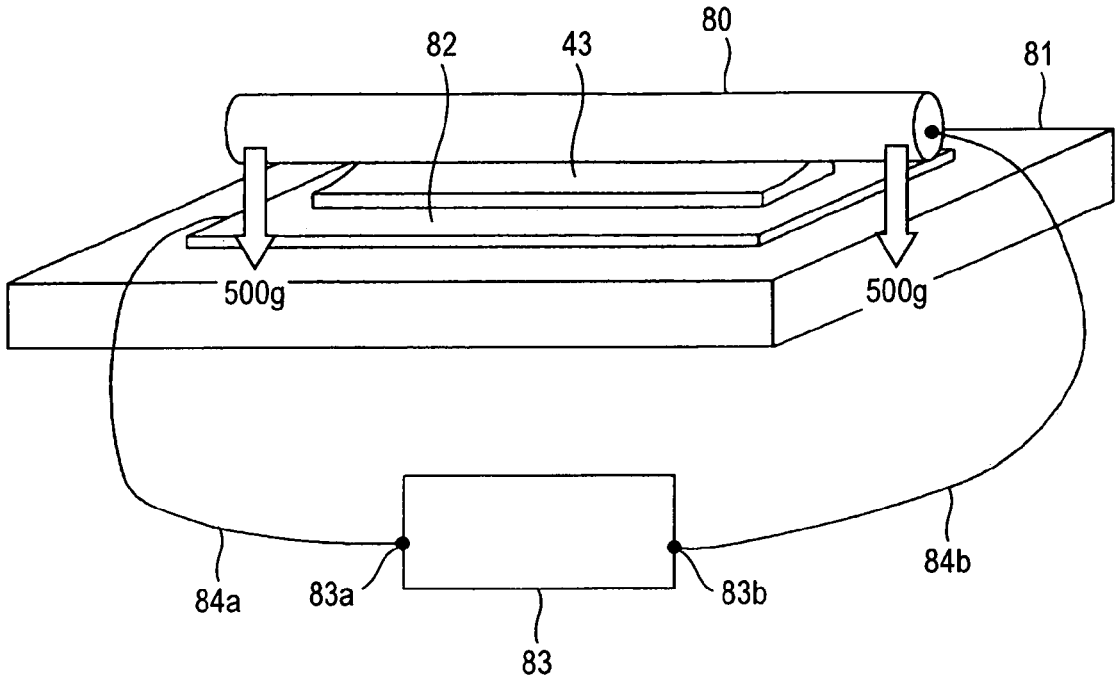
FIG. 3 is a diagram showing a method for measuring a resistance of an electroconductive thickness regulating blade.

FIG. 3 is a diagram showing a method for measuring the resistance of the electroconductive thickness regulating blade 43 in the experiment.

In FIG. 3, numeral 80 denotes a metallic bar having a diameter of 10 mm and a mass of 155 g, 81 denotes a pedestal, on which a metallic plate 82 is to be placed, 82 denotes a metallic plate, on which the electroconductive thickness regulating blade 43 is to be placed, and 83 denotes a resistance meter for measuring the resistance of the electroconductive thickness regulating blade 43. Two terminals 83*a* and 83*b* are connected to the metallic plate 82 and the metallic bar 80 through electroconductive wires 84*a* and 84*b*, respectively.

The electroconductive thickness regulating blade 43 is placed on the metallic plate 82, and the metallic bar 80 is placed on the electroconductive thickness regulating blade 43 in such a manner that the longitudinal direction of the electroconductive thickness regulating blade 43 is in parallel to the longitudinal direction of the axis of the metallic bar 80. A load of 500 g is applied to both ends of the metallic bar 80 placed on the electroconductive thickness regulating blade 43, and the resistance between the metallic bar 80 and the metallic plate 82 is measured with the resistance meter 83.

Samples of the electroconductive thickness regulating blade 43 were produced by using electroconductive millable silicone rubber or electroconductive liquid silicone rubber and were measured for resistance by the aforementioned measuring method with the voltage applied between the metallic bar 80 and the metallic plate 82 varied to 1 V, 2V and 3V.

Table 4 shows results of the measurement of the resistance of the electroconductive thickness regulating blades 43 used in the aspect.

TABLE 4

| Sample | | Resistance ($10^3$ Ω) | | |
|---|---|---|---|---|
| Material | No. | 1 V | 2 V | 3 V |
| Electroconductive | 1 | 0.25 | 0.17 | — |
| millable silicone | 2 | 0.81 | 0.3 | 0.21 |
| rubber (first | 3 | 0.47 | 0.24 | 0.17 |
| measurement) | 4 | 0.52 | 0.27 | 0.19 |
| | 5 | 0.75 | 0.27 | 0.19 |
| | Average value | 0.56 | 0.25 | 0.19 |
| Electroconductive | 1 | 2.2 | 0.84 | 0.48 |
| millable silicone | 2 | 1.5 | 0.7 | 0.47 |
| rubber (second | 3 | 3.9 | 0.17 | 0.89 |
| measurement) | 4 | 2.2 | 0.75 | 0.45 |
| | 5 | 2.2 | 0.93 | 0.59 |
| | Average value | 2.4 | 0.68 | 0.58 |
| Total average value of resistance | | | 0.8 | |
| Electroconductive | 1 | 0.16 | 0.11 | — |
| liquid silicone rubber | 2 | 0.3 | 0.19 | — |
| (second measurement) | 3 | 0.13 | — | — |
| | 4 | 0.36 | 0.22 | 0.16 |
| | 5 | 0.29 | 0.16 | — |
| | Average value | 0.25 | 0.17 | — |
| Total average value of resistance | | | 0.21 | |

[Table 4]

Table 4 shows results of the measurement of the resistance of the electroconductive thickness regulating blades 43 used in the aspect.

As shown in FIG. 4, the electroconductive thickness regulating blade 43 formed of electroconductive millable silicone rubber had an average resistance of $0.80\times10^3$ Ω, and the electroconductive thickness regulating blade 43 formed of electroconductive liquid silicone rubber had an average resistance of $0.21\times10^3$ Ω. The average value of resistances obtained by applying a voltage of 1 V to the electroconductive thickness regulating blade 43 formed of electroconductive liquid silicone rubber in five times, i.e., $0.25\times10^3$ Ω, was designated as the resistance of the electroconductive thickness regulating blade 43 in Experiment 1.

It is understood as follows according to the results of the experiments. By using the electroconductive thickness regulating blade 43 having a resistance of $10^3$ Ω or less, longitudinal streaks on images are suppressed from occurring, and the service life is improved in terms of number of sheets with high quality images. In particular, by using the electroconductive thickness regulating blade 43 formed of electroconductive millable silicone rubber having a resistance of $0.8\times10^3$ Ω or less, the developing roller and the toner are suppressed from being damaged to prevent scratches on the developing roller and the external additive released from the toner from occurring, whereby longitudinal streaks on images are suppressed from occurring to improve the service life in terms of number of sheets with high quality images. Furthermore, by using the electroconductive thickness regulating blade 43 formed of electroconductive liquid silicone rubber having a resistance of $0.2\times10^3$ Ω or less, the developing roller and the toner are suppressed from being damaged to prevent scratches on the developing roller and the external additive released from the toner from occurring, whereby longitudinal streaks on images are suppressed from occurring to improve the service life in terms of number of sheets with high quality images, and moreover, the electroconductive thickness regulating blade 43 is hard to be charged owing to the smaller resistance than electroconductive millable silicone rubber to prevent the external additive released from the toner and dusts from the outside of the developing cartage 29 from being attached to the electroconductive thickness regulating blade 43.

What is claimed is:

1. A developing device comprising a developer carrier capable of carrying a developer, and a thickness regulating member regulating a thickness of a layer of a developer carried by the developer carrier, the thickness regulating member comprising electroconductive rubber having a resistance of $0.8\times10^3$ Ω or less.

2. The developing device as claimed in claim 1, wherein the developer is produced by a polymerization method and has a coverage of an external additive on polymerized particles of 100%.

3. A developing device comprising a developer carrier capable of carrying a developer, and a thickness regulating member regulating a thickness of a layer of a developer carried by the developer carrier, wherein the thickness regulating member comprises electroconductive liquid silicone rubber having a resistance of $0.2\times10^3$ Ω or less.

4. A developing device comprising a developer carrier capable of carrying a developer, and a thickness regulating member regulating a thickness of a layer of a developer carried by the developer carrier, wherein the thickness regulating member comprises electroconductive millable silicone rubber having a resistance of $0.8\times10^3$ Ω or less.

5. An image forming apparatus comprising:

a developing device that is detachably mounted and comprises:

a developer carrier capable of carrying a developer, and a thickness regulating member regulating a thickness of a layer of a developer carried by the developer carrier, the thickness regulating member comprising electroconductive rubber having a resistance of $0.8\times10^3$ Ω or less.

* * * * *